US006691474B2

(12) United States Patent
Richardson

(10) Patent No.: US 6,691,474 B2
(45) Date of Patent: Feb. 17, 2004

(54) GLAZING BAR END CAPS

(75) Inventor: Christopher Richardson, Clitheroe (GB)

(73) Assignee: Ultraframe (UK) Limited, Lancashire (GB)

( * ) Notice: Subject to any disclaimer, the term of this patent is extended or adjusted under 35 U.S.C. 154(b) by 0 days.

(21) Appl. No.: 09/794,522

(22) Filed: Feb. 27, 2001

(65) Prior Publication Data

US 2001/0017014 A1 Aug. 30, 2001

(30) Foreign Application Priority Data

Feb. 28, 2000 (GB) ..... 0004710

(51) Int. Cl.[7] ..... E04C 3/30

(52) U.S. Cl. ..... 52/204.53; 52/734.2; 52/734.1; 52/730.3; 52/100

(58) Field of Search ..... 52/204.5, 204.53, 52/204.59, 100, 300, 312, 734.1, 734.2, 730.3, 730.4, 730.5, 730.6, 94, DIG. 8, DIG. 17, 98; 425/588; 446/87, 88

(56) References Cited

U.S. PATENT DOCUMENTS

| | | | | | |
|---|---|---|---|---|---|
| 2,347,561 | A | * | 4/1944 | Howard et al. | 434/372 |
| 2,771,110 | A | * | 11/1956 | Tuck | 52/98 |
| 3,828,511 | A | * | 8/1974 | Broberg | 52/745.21 |
| 4,201,019 | A | * | 5/1980 | Jones | 52/15 |
| 5,155,952 | A | * | 10/1992 | Herwegh et al. | 52/100 |
| 5,163,257 | A | * | 11/1992 | Crowell | 52/200 |
| 5,924,263 | A | * | 7/1999 | Richardson | 52/235 |
| 6,148,565 | A | * | 11/2000 | Lancaster | 52/13 |
| 6,385,927 | B2 | * | 5/2002 | Schiedegger et al. | 52/211 |

FOREIGN PATENT DOCUMENTS

| | | | | |
|---|---|---|---|---|
| EP | 0857837 A2 | * | 8/1998 | E04D/3/08 |
| EP | 0864708 A2 | * | 9/1998 | E04D/3/08 |
| EP | 1114899 A2 | * | 7/2001 | E04D/3/08 |
| GB | 2116619 A | * | 9/1983 | E06B/3/60 |
| GB | 2321925 A | | 8/1988 | |
| GB | 2310869 A | * | 9/1997 | E04B/7/02 |
| GB | 2337778 A | * | 12/1999 | E04B/7/06 |

* cited by examiner

*Primary Examiner*—Carl D. Friedman
*Assistant Examiner*—Brian E. Glessner
(74) *Attorney, Agent, or Firm*—Wood, Phillips, Katz, Clark & Mortimer

(57) ABSTRACT

In a glazing beam system comprising a glazing beam and upper and lower cappings locatable on the glazing beam, and end cap system comprises an end cap, which is mountable on an end of the glazing beam, via a bracket securable to the glazing beam end. After the bracket and the end cap are formed integrally, the bracket is separable from the end cap for attaching to the glazing beam.

34 Claims, 4 Drawing Sheets

GLAZING BAR END CAPS

TECHNICAL FIELD OF THE INVENTION

This invention concerns improvements relating to end caps for use on glazing bars.

BACKGROUND OF THE INVENTION

Glazing bars for constructing roofs or conservatories generally comprise aluminium glazing beams, between which are mounted glazing panels, and upper and lower cappings to secure and seal the roofing panels and conceal the aluminium beams. Typical glazing beams are of inverted T-section with a channel shaped capping fitted to the cross bar of the T-section and an upper capping which has divergent sides and internally a means for connecting the upper capping to the top of the aluminium beam, usually in a press fit manner. Top ends of the glazing beams are concealed beneath ridge covers but their lower ends at the eaves of a conservatory structure are visible and need to be covered, for example by an end cap, to give a neat and attractive finish to the conservatory roof.

In order to attach the end cap to the aluminium glazing beam end, the end cap may be screwed directly to the aluminium glazing beam end, which is formed with a screw port for that purpose. However, water may travel from the outside of the end cap through to the glazing beam, via the screw hole in the end cap. Such an ingress of water is undesirable and may cause the screw to rust. Also access to the screw is difficult when the gutter is in place and some site locations of glazing bars will make it difficult to access the end screw.

An improved system for mounting an end cap onto the end of a glazing bar, which alleviates the problems associated with screwing the end cap directly to the glazing beam end, is disclosed in our co-pending UK patent application, GB 2321925A. This document discloses that a bracket, providing a pair of opposed ends or lugs, may be screwed into a screw port in the end of the glazing beam, the end cap being provided with a pair of cooperating internal formations, for example facing channels, whereby the opposed ends or lugs of the bracket fit slidingly into the channels of the end cap, thereby mounting the end cap to the end of the glazing beam. This system for attaching the end cap to the glazing beam end significantly reduces the possibility of any ingress of water from the outside of the end cap to the glazing beam, there being no screw hole in the end cap through to the glazing beam end. Generally, both the end caps and the brackets are formed by injection moulding processes.

However, there are problems associated with the end caps currently in use, in that the end caps themselves have to be moulded separately from the brackets, resulting in there being an increased number of mould parts required. This need for two separate sets of mould parts significantly increases the costs associated with manufacturing the end cap and bracket assemblies.

SUMMARY OF THE INVENTION

An object of this invention is to provide an improved end cap.

According to a first aspect of this invention there is provided an end cap system for a glazing system comprising a glazing beam, upper and lower cappings locatable on the beam, the end cap system comprising an end cap and a bracket for mounting the end cap on an end of the glazing beam, wherein the bracket and end cap are formed integrally, the bracket being separable from the end cap for attachment to the glazing beam.

According to a second aspect the present invention provides a glazing beam system comprising a glazing beam, upper and lower cappings locatable on the beam, an end cap therefor, means for mounting the end cap on an end of the glazing beam in the form of a bracket securable to the glazing beam end, wherein the bracket and end cap are formed integrally, the bracket being separable from the end cap for attachment to the glazing beam end.

In a preferred embodiment of the invention, the end cap has an aperture therethrough. It is further preferable that the bracket is initially attached to the end cap within the aperture in the front face of the end cap. Preferably, the bracket is attached to the end cap by means of spaced frangible links, whereby in use, to separate the bracket from the end cap, the links are broken.

The end cap and bracket are preferably formed by injection moulding. By having the bracket linked to the end cap in its aperture this facilitates onepiece moulding.

The aperture of the end cap is conveniently closed by an attachment that may be in the form of a decorative moulding. The attachment is preferably releasably securable to the end cap. Preferably the end cap front face has a recess to receive the decorative attachment. It is further preferable that the shape and size of the recess in the front face of the end cap corresponds to the shape and size of the decorative attachment to be releasably secured therein.

It is preferable that the decorative attachment has at its edge a continuous lip or spaced tabs notched or ribbed to snap fit to the edge of the aperture.

The provision of decorative attachments is advantageous in being able to provide customers with design selection. Naturally, it is to the customer's advantage to have a wide range of moulded designs on the front of their end caps to choose from, when planning their conservatory or glazed roof. Up until now, to meet the customer's requirement for a variety of designs from which to choose, manufacturers of end caps have had to make a new mould for each end cap, for each decorative design required. This adds considerably to the costs involved in manufacturing decorative end caps, in that the mould for the whole of the end cap has to be different for each design to be applied to the front of the end cap, even though the only difference between two decorative end caps may be the actual moulded design on the front of the end cap, for example a Lancashire rose design as opposed to a Yorkshire rose design.

Furthermore, due to the one-piece nature of the decorative end cap, once the design has been chosen by the customer it is not possible to change the design on the front of the cap without changing the whole of the end cap.

Preferably, the bracket is securable to the end of the glazing beam by means of a screw through the bracket into a screw port of the glazing beam. The bracket and the end cap preferably have mutually engageable formations, whereby they slidingly interfit. One of the bracket and the end cap preferably provides a pair of facing channels and the other has a pair of oppositely facing lugs or the like, which are a sliding fit in the channels. More preferably still, the bracket provides the oppositely facing lugs or the like, and the end cap provides the pair of facing channels, whereby the oppositely facing lugs or the like of the bracket are a sliding fit in the channels of the end cap. Having the bracket screw hidden by the end cap provides a more aesthetically pleasing appearance at glazing bar ends.

Preferably, the end cap has a rim with sufficient depth to extend rearwards over the ends of the upper and lower cappings. It is further preferable that there is a stop means provided in at least one channel of the end cap, to ensure that the end cap locates in the correct position relative to the end of the glazing beam when it is mounted thereon. More preferably still, the end cap has a rim that is deeper at its top, whereby the end cap when fitted covers the end of the upper capping. This allows additional fixing from the top by means of a screw through the rim.

To facilitate fitting of end caps of the invention the bracket can be fitted to a glazing bar in the factory or on site, leaving the end cap to be slid into place, once the glazing panels and top capping are in position. Conveniently, the end cap can be removed simply if necessary, without access to the screw securing the bracket being required.

BRIEF DESCRIPTION OF THE DRAWINGS

The invention will now be further described, by way of example only, with reference to the accompanying drawings, in which.

DETAILED DESCRIPTION OF THE ILLUSTRATED EMBODIMENT

Figure 1:
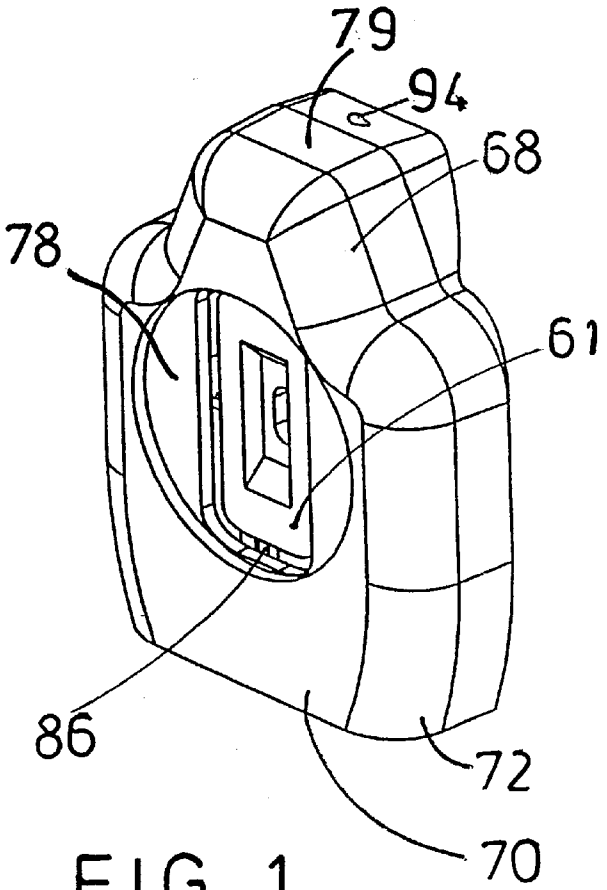
FIG. 1 is a front view of an end cap of the invention with the bracket still attached.
Figure 2:
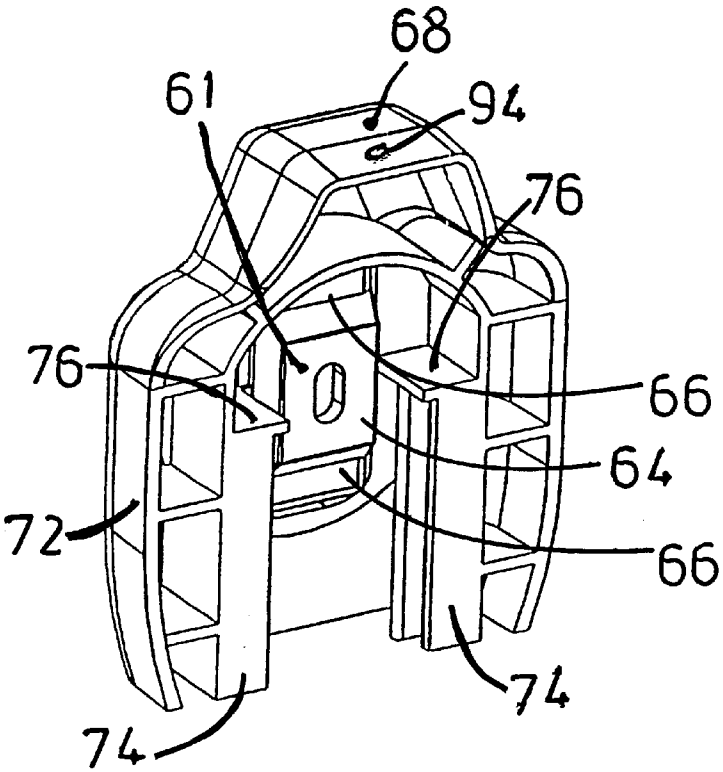
FIG. 2 is a rear view of the end cap of FIG. 1.
Figure 3:
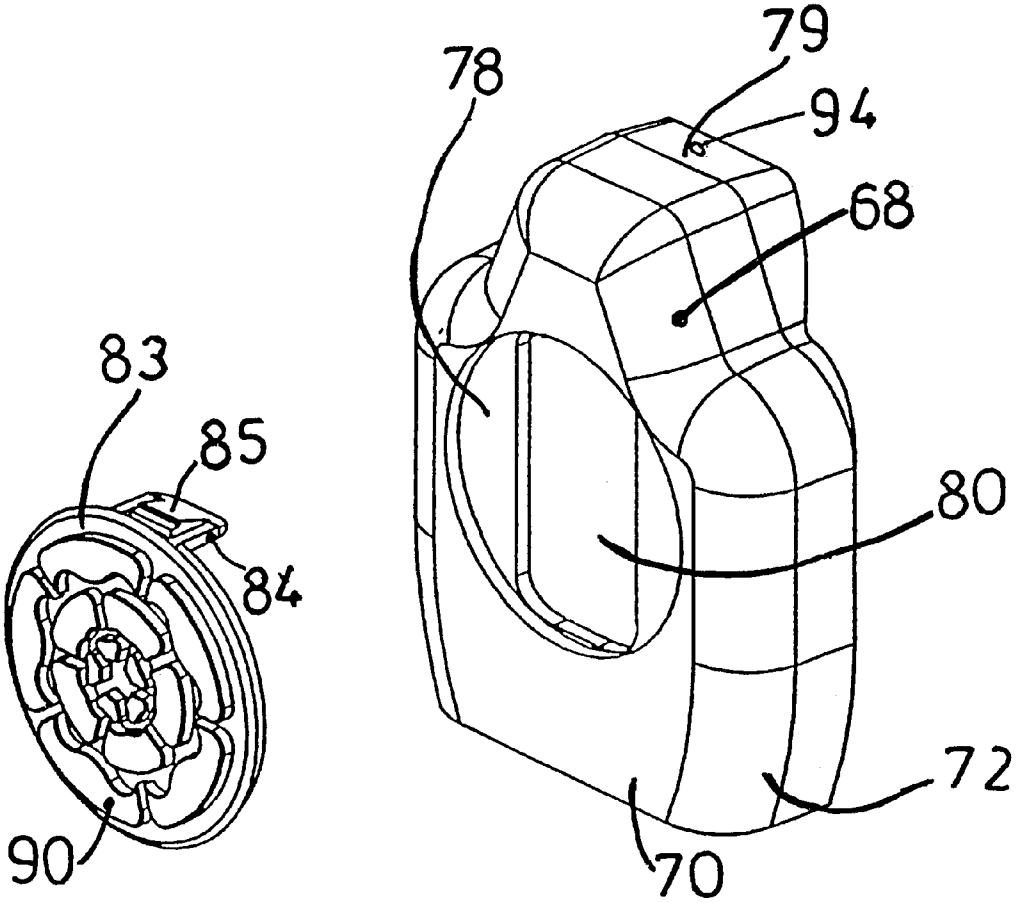
FIG. 3 is a front exploded view of a decorative end cap of the invention with the bracket removed.
Figure 4:
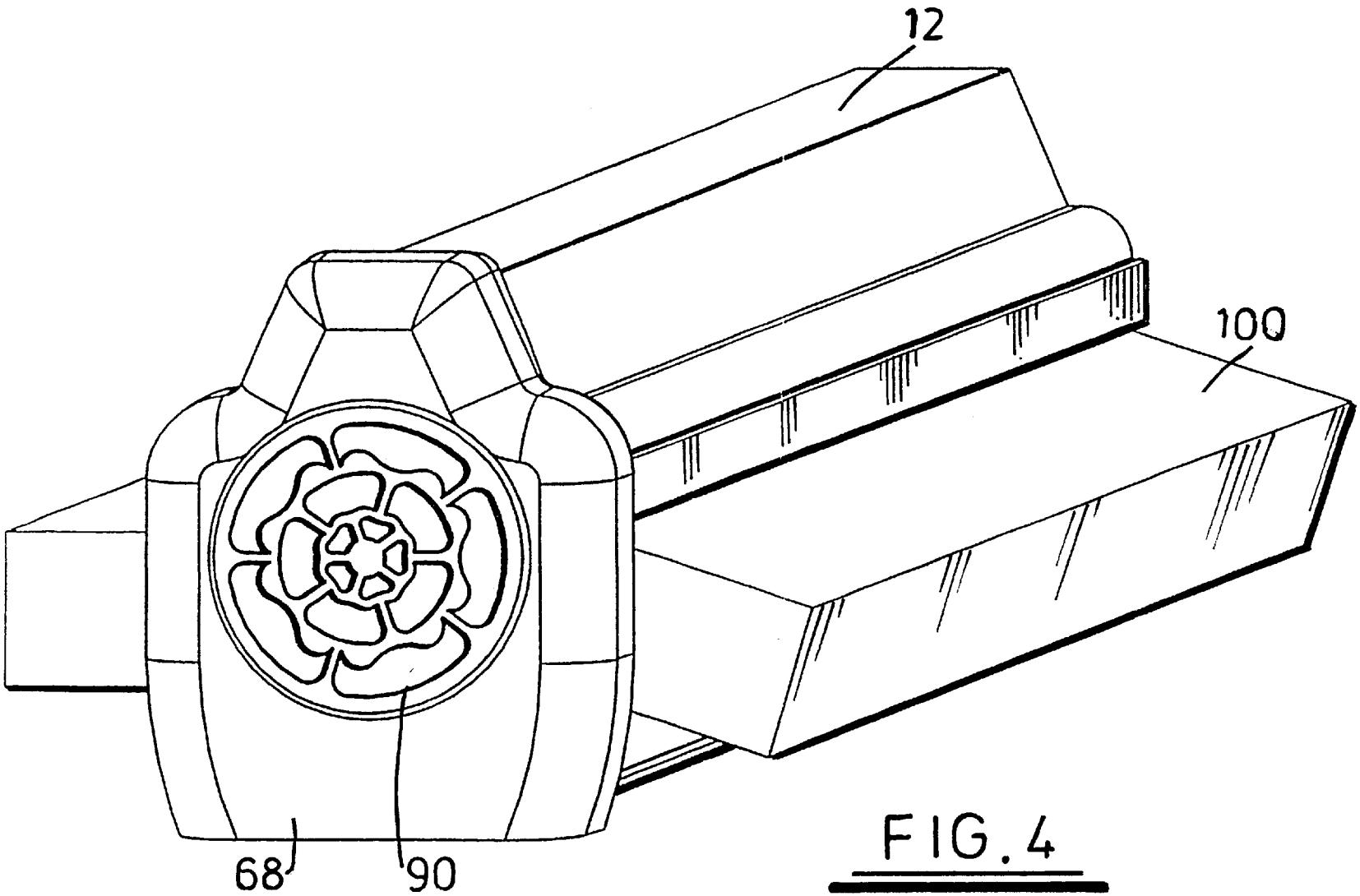
FIG. 4 is a front perspective view of a glazing beam system of the invention.
Figure 5:
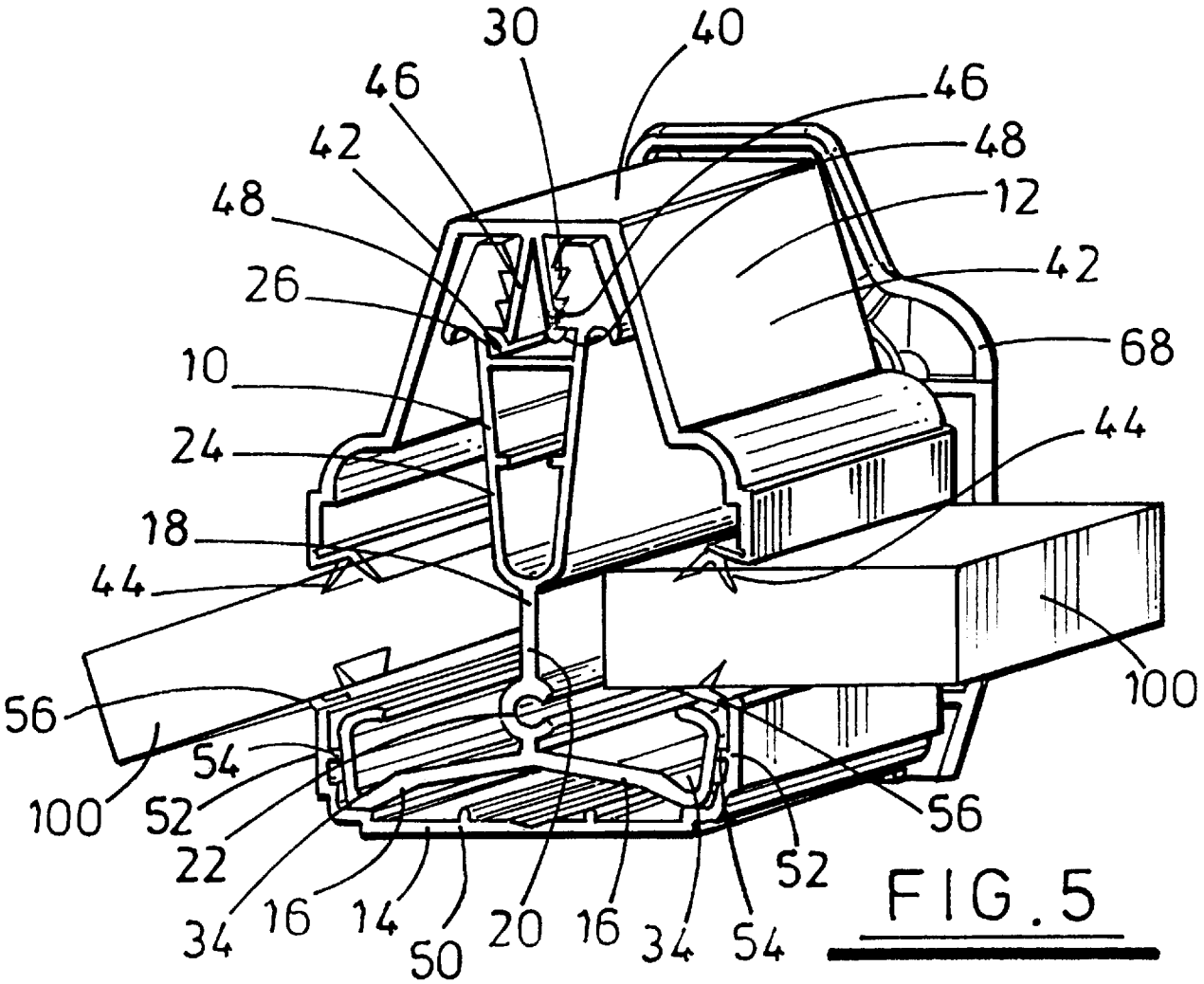
FIG. 5 is a rear perspective of the glazing beam system of FIG. 4.

Referring to the accompanying drawings, a glazing beam system comprises a glazing beam 10 of aluminium and upper and lower cappings 12 and 14 respectively of u-PVC. In use, roofing panels 100, such as of transparent plastics material, for example polycarbonate, will have their edges sandwiched between the upper and lower cappings 12 and 14 on opposite sides of the roof beam arrangement.

The glazing beam 10 is generally of inverted T-section. Thus, the beam 10 has a pair of flanges 16, which are turned back on themselves at their remote ends, and an upstanding limb 18. The limb 18 comprises a stem 20 extending from the junction of the flanges 16 and including a screw port 22, a hollow generally triangular section main part 24 above the screw port 22 and an upwardly open channel 26 above the main port 22. The channel 26 has generally parallel sides. On the inside of each side is a series of notches 30 forming downwardly open recesses.

Each flange 16 has a first part generally perpendicular to the upstanding limb 18 and a second part which forms a trough 34 remote from the upstanding limb 18. The upper capping 12 is generally of inverted V-section but comprises a flat top 40 and depending sides 42. The remote edges of the sides 42 have gaskets 44 formed thereon by co-extrusion or bonding of rubber or synthetic elastomeric material. Internally of the capping 12 and depending from its flat top 40 is a pair of resilient divergent flaps 46 having outwardly projecting tops 48 at their ends.

The lower capping 14 is generally formed as a channel section having a flat base 50 and upstanding side walls 52. Internally of the channel on the base 40 and on the side walls 52 are spacing projections 54. The free edges of the side walls 52 have co-extruded thereon, from rubber or synthetic elastomeric material, gaskets 56 which extend inwardly and are inclined slightly upwardly. The gaskets 56 include resiliently deformable projections on their upper surface along their outermost edges and centrally thereof.

To assemble a roof, the aluminium glazing beams 10 are fixed in position between a ridge and the eaves of a conservatory roof. The lower cappings 14 are fitted onto the beams either before or after the beams are fixed in place. The glazing panels 100 are positioned between the beams with their side edges on the gaskets 56, which are thereby trapped between the beam flanges and the glazing panels. Then the upper cappings are pressed down onto the beams with their deformable flaps 46 being trapped in the upwardly open channels 26 of the support beams.

An end cap 68 for the glazing beam 10 has a front face 70 and a rim 72. The front face 70 of the end cap 68 has an aperture 80 in a recess 78 thereof with a bracket 61 initially integral with the end cap 68 held in the aperture 80 by means of frangible links 86. To attach the end cap 68 to the glazing beam end, the links 86 are broken, thereby releasing the bracket 61 from the end cap 68. At the end of the glazing beam 10, the bracket 61 is fixed by means of a screw (not shown) through the bracket into the screw port 22 of the glazing beam. The bracket 61 has a wider central section 64 and narrower opposed ends 66, whereby the ends are spaced from the end of the glazing beam.

On its intended inner face the end cap 68 has a pair of facing open channels 74, which are slid over the ends of the bracket 61 to fit the end cap to the glazing beam. The rim 72 of the end cap is of sufficient depth to extend rearwards over the ends of the upper and lower cappings. The end cap rim 72 widens to a central part 79 at the top of the cap, to ensure that the cap 68 rests on the top of the upper capping when slid into place on the bracket. A stop means 76 is located at the top of each facing open channel 74 to ensure that the end cap 68 locates in the correct position on the glazing beam when it is mounted thereon. Additionally a fixing screw can be inserted through screw hole 94 in the top of the rim 72.

A decorative attachment 83 is circular in shape, with a decorative design 90 moulded thereon. However, it is to be appreciated that any suitable shape or design of decorative attachment may be used in the invention. The decorative attachment has two tabs 84 oppositely spaced, each with a raised nodule 85. To attach the decorative attachment to the end cap, the decorative attachment is push-fitted into the aperture 80, which is left behind by the removal of the bracket 61, and is releasably held therein by the tabs on the decorative attachment, the nodules of which snap-fit past the edge of the aperture.

Thus, the illustrated end cap provides a neat decorative finish to the glazing beams for a conservatory roof, the integral end cap and bracket being more economical to manufacture than separate end caps and brackets in that there is no need for separate end cap and bracket mould sets to be manufactured. Furthermore, the separate end cap and decorative attachments are also more economical to manufacture than, for example a range of one-piece decorative end caps. For example, after removal of the brackets, standard end caps have standard holes in the recesses therein for receiving the tabs of the decorative attachments, enabling decorative attachments, which are formed as standard but for the design moulded thereon, to be attached to the end caps and changed if necessary.

What is claimed is:

1. An end cap system for a glazing system comprising a glazing beam having an end, upper and lower cappings on the beam, the end cap system comprising an end cap, and a bracket for mounting the end cap on the end of the glazing beam, wherein the bracket and end cap are formed integrally, the bracket being separable from the end cap for attachment to the glazing beam, and wherein the end cap has an aperture therethrough.

2. An end cap system for a glazing system as claimed in claim 1, the end cap having a front face, wherein the bracket is initially attached to the end cap within the aperture, which is in the front face of the end cap.

3. An end cap system for a glazing system as claimed in claim 1, wherein the bracket is attached to the end cap by means of spaced frangible links.

4. An end cap system for a glazing system as claimed in claim 1, wherein the end cap and bracket are formed by injection moulding.

5. An end cap system for a glazing system as claimed in claim 1, wherein the end cap is closed by an attachment.

6. An end cap system for a glazing system as claimed in claim 5, wherein the attachment is in the form of a decorative moulding.

7. An end cap system for a glazing system as claimed in claim 5, wherein the attachment is releasable securable to the end cap.

8. An end cap system for system for a glazing system as claimed in claim 1, the end cap having a decorative attachment for covering the aperture, the end cap having a front face, wherein the end cap has a recess to receive the decorative attachment.

9. An end cap system for a glazing system as claimed in claim 8, wherein the shape and size of the recess in the front face of the end cap corresponds to the shape and size of the decorative attachment to be releasable secured therein.

10. An end cap system for a glazing system as claimed in claim 5, wherein the aperture has an edge and wherein the attachment is a decorative attachment, which has an edge having a continuous lip or spaced tabs notched or ribbed to snap fit to the edge of the aperture.

11. An end cap system for a glazing system as claimed in claim 1, the glazing beam having a screw port, wherein the bracket is securable to the end of the glazing beam by means of a screw through the bracket into the screw port of the glazing beam.

12. An end cap system for a glazing system as claimed in claim 1, wherein the bracket and the end cap have mutually engageable formations whereby the bracket and end cap slidably interfit.

13. An end cap system for a glazing system for a glazing system as claimed in claim 1, wherein one of the bracket and the end cap provides a air of facing channels and the other has a pair of oppositely facing lugs, a sliding fit in the channels.

14. An end cap system for system for a glazing system as claimed in claim 13, wherein the bracket provides the oppositely facing lugs and the end cap provides the pair of facing channels, whereby the oppositely facing lugs are a sliding fit in the channels of the end cap.

15. An end cap system for system for a glazing system as claimed in claim 1, wherein the end cap has a rim with sufficient depth to extend rearwards over the ends of the upper and lower cappings.

16. An end cap system for system for a glazing system as claimed in claim 13, wherein there is provided a stop means in at least one channel of the end cap, to ensure that the end cap locates in the correct position relative to the end of the glazing beam when the end cap is mounted thereon.

17. An end cap system for a glazing system as claimed in claim 15, wherein the rim has a top, at which the rim is deeper, whereby the end cap when fitted covers the end of the upper capping.

18. A glazing beam system comprising a glazing beam having an end, upper and lower cappings locatable on the beam, an end cap therefor, means for mounting the end cap on the end of the glazing beam in the form of a bracket securable to the glazing beam end, wherein the bracket and end cap are formed integrally, the bracket being separable from the end cap for attachment to the glazing beam end, and wherein the end cap has an aperture therethrough.

19. A glazing beam system as claimed in claim 18, the end cap having a front face, wherein the bracket is initially attached to the end cap within the aperture, which is in the front face of the cap.

20. A glazing beam system as claimed in claim 18, wherein the bracket is attached to the end cap by means of spaced frangible links.

21. A glazing beam system as claimed in claim 18, wherein the end cap and bracket are formed by injection moulding.

22. A glazing beam system as claimed in claim 18, wherein the aperture of the end cap is closed by an attachment.

23. A glazing beam system as claimed in claim 22 wherein the attachment is in the form of a decorative moulding.

24. A glazing beam system as claimed in claim 22, wherein the attachment is releasable securable to the end cap.

25. A glazing beam system as claimed in claim 18, the end cap having a front face and the aperture being in the front face, and having a decorative attachment for covering the aperture, wherein the end cap front face has a recess to receive the decorative attachment.

26. A glazing beam system as claimed in claim 25, wherein the shape and size of the recess in the front face of the end cap corresponds to the shape and size of the decorative attachment to be releasable secured therein.

27. An end cap system for a glazing beam system as claimed in claim 22 wherein the aperture has an edge and wherein the attachment is a decorative attachment, which has an edge having a continuous lip or spaced tabs notched or ribbed to snap fit to the edge of the aperture.

28. A glazing beam system as claimed in claim 18, the glazing beam having a screw port, wherein the bracket is securable to the end of the glazing beam by means of a screw through the bracket into the screw port of the glazing beam.

29. A glazing beam system as claimed in claim 18, wherein the bracket and the end cap have mutually engageable formations whereby the bracket and end cap slidably interfit.

30. A glazing beam system as claimed in claim 18, wherein one of the bracket and the end cap provides a pair of facing channels and the other has a pair of oppositely facing lugs, which are a sliding fit in the channels.

31. A glazing beam system as claimed in claim 30, wherein the bracket provides the oppositely facing lugs, and the end cap provides the pair of facing channels, whereby the oppositely facing lugs of the bracket are a sliding fit in the channels of the end cap.

32. A glazing beam system as claimed in claim 18, wherein the end cap has a rim with sufficient depth to extend rearwards over the ends of the upper and lower cappings.

33. A glazing beam system as claimed in claim 30, wherein there is provided a stop means in at least one channel of the end cap, to ensure that the end cap locates in the correct position relative to the end of the glazing beam when the end cap is mounted thereon.

34. A glazing beam system as claimed in claim 32, wherein the rim has a top, at which the rim is deeper, whereby the end cap when fitted covers the end of the upper capping.

* * * * *